US008931180B2

(12) United States Patent
Davis et al.

(10) Patent No.: US 8,931,180 B2
(45) Date of Patent: Jan. 13, 2015

(54) UTILITY CUTTER

(71) Applicant: ADCO Industries-Technologies, L.P., Dallas, TX (US)

(72) Inventors: Raymond E. Davis, Heath, TX (US); Clifton Glenn Hampton, Burleson, TX (US)

(73) Assignee: ADCO Industries—Technologies, L.P., Dallas, TX (US)

( * ) Notice: Subject to any disclaimer, the term of this patent is extended or adjusted under 35 U.S.C. 154(b) by 0 days.

(21) Appl. No.: 13/674,567

(22) Filed: Nov. 12, 2012

(65) Prior Publication Data

US 2013/0067751 A1 Mar. 21, 2013

Related U.S. Application Data

(63) Continuation of application No. 12/488,229, filed on Jun. 19, 2009, now Pat. No. 8,307,556.

(51) Int. Cl.

| | |
|---|---|
| ***B26B 3/06*** | (2006.01) |
| ***B26B 13/00*** | (2006.01) |
| ***B26B 1/00*** | (2006.01) |
| ***F41B 13/02*** | (2006.01) |
| ***F41C 27/18*** | (2006.01) |
| ***B26B 5/00*** | (2006.01) |

(52) U.S. Cl.

CPC ..... *B26B 5/003* (2013.01)
USPC ..... 30/162; 30/335; 30/241

(58) Field of Classification Search

CPC ..... B26B 5/001; B26B 5/003; B26B 5/005; B23D 51/10
USPC ..... 30/161–162, 272.1, 292–293, 335, 337, 30/339, 241–242, 2, 329
See application file for complete search history.

(56) References Cited

U.S. PATENT DOCUMENTS

| | | | | |
|---|---|---|---|---|
| 2,018,149 | A | 10/1935 | Randle et al. | |
| 3,439,419 | A | 4/1969 | Fleming | |
| 3,593,417 | A * | 7/1971 | West et al. | 30/125 |
| 4,005,525 | A * | 2/1977 | Gringer | 30/125 |
| 4,134,206 | A | 1/1979 | Beermann | |
| 4,139,939 | A | 2/1979 | Crooks | |
| 4,180,908 | A | 1/1980 | Beermann | |
| 4,320,576 | A | 3/1982 | Beermann | |
| 4,683,656 | A * | 8/1987 | Peyrot et al. | 30/162 |
| 4,713,885 | A * | 12/1987 | Keklak et al. | 30/162 |
| 4,757,612 | A * | 7/1988 | Peyrot | 30/151 |

(Continued)

FOREIGN PATENT DOCUMENTS

| | | |
|---|---|---|
| DE | 8704973 U1 | 7/1987 |
| DE | 4315495 A1 | 11/1994 |

(Continued)

*Primary Examiner* — Ghassem Alie
*Assistant Examiner* — Bharat C Patel
(74) *Attorney, Agent, or Firm* — Fish & Richardson P.C.

(57) ABSTRACT

A knife according to the present disclosure includes a housing and a blade. The blade includes a blade edge adapted to engage a material, and the blade is coupled to a blade shuttle. The blade and blade shuttle are substantially enclosed within the housing when the blade shuttle is in a retracted position, and the blade is extended from the housing when the blade shuttle is in an extended position. The blade shuttle is adapted to be conveyed to the retracted position based on the blade receiving a force directed substantially perpendicular to the blade edge.

20 Claims, 4 Drawing Sheets

(56) References Cited

U.S. PATENT DOCUMENTS

| | | | | |
|---|---|---|---|---|
| 4,769,912 | A | 9/1988 | Davis | |
| 4,805,304 | A | 2/1989 | Knoop | |
| 4,835,865 | A | 6/1989 | Knoop | |
| 4,837,931 | A | 6/1989 | Beermann | |
| 4,868,985 | A | 9/1989 | Rehm | |
| 4,899,443 | A | 2/1990 | Beermann | |
| 4,949,458 | A | 8/1990 | Davis et al. | |
| 5,012,581 | A | 5/1991 | Fletcher et al. | |
| 5,133,132 | A | 7/1992 | Yu | |
| 5,203,085 | A | 4/1993 | Berns | |
| 5,299,355 | A * | 4/1994 | Boda et al. | 30/162 |
| 5,303,474 | A * | 4/1994 | Keklak et al. | 30/162 |
| 5,337,482 | A | 8/1994 | Schmidt | |
| 5,384,963 | A | 1/1995 | Beermann | |
| 5,386,632 | A | 2/1995 | Schmidt | |
| 5,426,855 | A * | 6/1995 | Keklak et al. | 30/162 |
| 5,481,804 | A | 1/1996 | Platts | |
| 5,598,634 | A | 2/1997 | Berns | |
| 5,613,300 | A * | 3/1997 | Schmidt | 30/2 |
| 5,617,635 | A | 4/1997 | Berns | |
| 5,647,132 | A | 7/1997 | Berns | |
| 5,735,051 | A | 4/1998 | Berns | |
| 5,737,842 | A | 4/1998 | Freedman | |
| 5,890,294 | A | 4/1999 | Keklak et al. | |
| 6,000,136 | A | 12/1999 | Owens | |
| 6,070,326 | A | 6/2000 | Berns | |
| 6,148,520 | A | 11/2000 | Berns | |
| 6,192,589 | B1 * | 2/2001 | Martone et al. | 30/125 |
| 6,195,896 | B1 | 3/2001 | Ireland | |
| 6,205,667 | B1 | 3/2001 | Glesser | |
| 6,233,832 | B1 | 5/2001 | Berns | |
| 6,308,418 | B1 | 10/2001 | Sweet | |
| 6,314,646 | B1 | 11/2001 | Schmidt | |
| 6,438,849 | B1 * | 8/2002 | Wonderley | 30/161 |
| 6,453,559 | B1 | 9/2002 | Marshall et al. | |
| 6,532,670 | B1 | 3/2003 | Berns | |
| 6,550,144 | B1 | 4/2003 | Berns | |
| 6,553,673 | B2 | 4/2003 | Peyrot et al. | |
| 6,578,266 | B2 | 6/2003 | Chomiak | |
| 6,591,501 | B1 | 7/2003 | Phillips | |
| 6,637,112 | B2 | 10/2003 | Davis | |
| 6,718,637 | B1 * | 4/2004 | Ortner et al. | 30/2 |
| 6,775,911 | B2 | 8/2004 | Tremblay | |
| 6,785,966 | B2 | 9/2004 | Berns | |
| 6,813,833 | B2 * | 11/2004 | Saunders et al. | 30/162 |
| 6,874,237 | B2 | 4/2005 | Robitaille | |
| 6,907,668 | B2 | 6/2005 | Polei | |
| 6,938,343 | B2 | 9/2005 | Yamagishi | |
| 7,028,406 | B2 | 4/2006 | Polei | |
| 7,134,207 | B2 * | 11/2006 | Ping | 30/125 |
| 7,322,110 | B2 | 1/2008 | Hernandez et al. | |
| 7,325,313 | B2 * | 2/2008 | Gringer et al. | 30/162 |
| 7,540,092 | B2 | 6/2009 | Polei | |
| 7,596,868 | B2 | 10/2009 | Berns | |
| 7,596,869 | B2 | 10/2009 | Berns | |
| 7,647,702 | B2 | 1/2010 | Polei | |
| 8,056,241 | B2 * | 11/2011 | Davis et al. | 30/162 |
| 8,307,556 | B2 * | 11/2012 | Davis et al. | 30/162 |
| 2002/0124412 | A1 | 9/2002 | Votolato | |
| 2002/0124418 | A1 * | 9/2002 | Votolato | 30/294 |
| 2002/0162849 | A1 | 11/2002 | Chen | |
| 2003/0140746 | A1 | 7/2003 | Yamagishi | |
| 2003/0154606 | A1 | 8/2003 | Saunders et al. | |
| 2004/0187314 | A1 | 9/2004 | Johnson | |
| 2004/0237312 | A1 * | 12/2004 | Hernandez et al. | 30/162 |
| 2005/0217114 | A1 | 10/2005 | Votolato | |
| 2006/0130338 | A1 | 6/2006 | Dzubak et al. | |
| 2007/0074402 | A1 | 4/2007 | Hernandez et al. | |
| 2007/0101576 | A1 | 5/2007 | Green | |
| 2007/0130778 | A1 | 6/2007 | Ruggiero | |
| 2007/0209209 | A1 * | 9/2007 | Davis et al. | 30/162 |
| 2007/0240314 | A1 | 10/2007 | Ireland | |
| 2008/0086894 | A1 | 4/2008 | Sullivan | |
| 2008/0086895 | A1 | 4/2008 | Parks | |
| 2008/0250651 | A1 * | 10/2008 | Davis et al. | 30/162 |
| 2008/0282546 | A2 * | 11/2008 | Ranieri et al. | 30/162 |
| 2008/0282547 | A1 | 11/2008 | Leger et al. | |
| 2009/0271988 | A1 * | 11/2009 | Votolato | 30/158 |

FOREIGN PATENT DOCUMENTS

| | | | |
|---|---|---|---|
| DE | 19601015 | A1 | 7/1997 |
| DE | 29709671 | U1 | 4/1998 |
| DE | 20202978 | A1 | 5/2002 |
| DE | 20210670 | U1 | 9/2002 |
| DE | 60101654 | T2 | 1/2004 |
| FR | 2552008 | A1 | 3/1985 |
| FR | 2893525 | A1 | 5/2007 |
| GB | 642219 | A | 8/1950 |
| GB | 649406 | A | 1/1951 |
| GB | 2083775 | | 3/1982 |
| GB | 2160539 | | 12/1985 |
| KR | 879807 | B1 | 7/1987 |
| KR | 199206556 | B1 | 3/1988 |
| KR | 199003560 | Y1 | 6/1988 |

* cited by examiner

UTILITY CUTTER

RELATED APPLICATIONS

This application is a continuation of U.S. patent application Ser. No. 12/488,229, filed Jun. 19, 2009, and entitled "Utility Cutter," now issued as U.S. Pat. No. 8,307,556, the contents of which are incorporated herein by reference in their entirety.

TECHNICAL BACKGROUND

This disclosure relates to cutting rigid, semi-rigid, and flexible materials, and more particularly, to cutting rigid, semi-rigid, and flexible materials with a utility cutter including a cutting blade retractable in response to force from one or more directions.

BACKGROUND

Utility cutters may be used to cut or slice a variety of materials, such as cardboard, corrugated board of varying thickness, rubber, lightweight plastic, or other packaging material. In order to cut or slice such material, the utility cutter may need to have a sharpened blade. Certain precautions may be used to protect or help protect a user from the sharpened blade. For example, a utility cutter may include guards that extend from the cutter alongside the sharpened blade, such that the guards substantially prevent an accidental injury to the user or other bystander. Further, a utility cutter may include a protective handle that encloses substantially all of a blade during periods of non-use. As with any sharp object, however, the chance of operator injury may be high when working with a utility cutter, which includes an exposed blade. Such injuries can occur during the operation of the utility knife in cutting the aforementioned material, or even during periods of non-operation if the user fails to carefully handle the knife For example, even if a utility knife includes a blade that may be completely concealed within a protective housing until operation, once the knife is actuated to reveal the blade, the responsibility of ensuring that the blade returns to the protective housing is often the user's. In situations where the user forgets to deactivate the knife, such that the blade is not returned to its protective housing, the exposed blade may cause injury to the user or others.

In some instances, an autoretractable blade, which may be automatically returned within a protective housing of the utility cutter when disengaged from the material, may help ensure the safety of the user. For example, a utility cutter with an autoretractable blade may help ensure that the sharpened blade of the cutter is not exposed from the housing during periods of disengagement from the material, regardless of whether the user has actuated (or maintained actuation of) a mechanism to extend the blade from the housing (e.g., a trigger). In many instances, such utility cutters rely on a frictional force exerted on the blade by the material being cut, such as the corrugated board, plastic, or cardboard. As the frictional force is exerted on the blade in these types of utility cutters, the blade may extend from the housing an incremental distance, substantially parallel to a cutting edge of the blade, in order to decouple a blade carrier from a mechanism used to extend the blade from the housing. Once decoupled, the blade carrier and blade may be free to automatically return within the housing when the blade is disengaged from the material.

Such utility cutters that rely on the friction generated between the blade and the material during the cutting process may also be used to cut a variety of flexible materials. Such flexible materials may include adhesive tape, polyfilm (or other polyurethane film), plastic bags, or other similar materials, such as high-density polyethylene (HDPE), low-density polyethylene (LDPE), or linear low-density polyethylene (LLDPE). As is typical, for example, adhesive tape or polyfilm may be used in conjunction with sealing or otherwise managing other forms of material often cut by utility cutters, such as corrugated board and cardboard. In some cases, due in part to the thickness of such flexible materials, the rigidity of such flexible materials, and/or relative surface smoothness, utility cutters that rely on a frictional force to decouple the blade carrier from the blade extension mechanism may not autoretract the blade into the cutter when cutting such materials, even when the blade is disengaged from the material.

SUMMARY

In one general embodiment, a knife according to the present disclosure includes a housing and a blade. The blade includes a blade edge adapted to engage a material, and the blade is coupled to a blade shuttle. The blade and blade shuttle are substantially enclosed within the housing when the blade shuttle is in a retracted position, and the blade is extended from the housing when the blade shuttle is in an extended position. The blade shuttle is adapted to be conveyed to the retracted position based on the blade receiving a force directed substantially perpendicular to the blade edge. In specific embodiments, the knife may further include a blade trigger pivotally coupled to the housing, where the blade shuttle is conveyed from the retracted position to the extended position when the blade trigger pivots from a rest position to an engaged position. The knife may further include a shuttle spring coupled to the blade shuttle and adapted to convey the blade shuttle to the retracted position.

In certain embodiments, the shuttle spring may be adapted to automatically convey the blade shuttle to the retracted position when the blade is disengaged from the material when the blade trigger is in the engaged position. The shuttle spring may exert no force on the blade shuttle when the blade shuttle is in the retracted position. The knife may further include a transmission adapted to transfer a rotational movement of the blade trigger as the blade trigger rotates from the rest position to the engaged position to a lateral movement directed to convey the blade shuttle from the retracted position to the extended position. In some aspects, the blade shuttle may further include a tang, and the knife may further include a rib coupled to an inner surface of the housing, where the tang is adjacent the rib as the blade shuttle is conveyed from the retracted position to the extended position. The rib may further include at least one notch therethrough, where the tang is adapted to protrude into the notch when the blade receives the force. The rib may be tapered adjacent the notch, where the tapered portion of the rib is angled away from the blade edge.

In various embodiments, the blade trigger may further include a cavity, and the knife may further include a trigger lock with a projection. The trigger lock may be substantially enclosed within the cavity and accessible at the exterior of the housing through the blade trigger. The trigger lock may be pivotally coupled to the blade trigger, and the projection may be in contact with a stop pin coupled to the housing when the blade shuttle is in the retracted position. The blade trigger may be substantially prevented from pivoting from the rest position to the engaged position when the projection is in contact with the stop pin. The projection may be released from the stop pin upon rotation of the trigger lock, and the blade trigger may be pivotable from the rest position to the engaged position when the projection is released from the stop pin.

In specific embodiments, the blade trigger may further include a cleft and the trigger lock may further include a notch. The notch may be adapted to engage the cleft upon rotation of the trigger lock and transfer rotational motion from the trigger lock to the blade trigger. The blade trigger may be adapted to rotate from the rest position to the engaged position when the notch engages the cleft.

In some embodiments, the blade shuttle may include a spring tongue and the blade trigger may further include a rail. The transmission may include at least one guide integrally formed in an interior surface of the housing; a lever coupled to the housing, where the lever includes at least one lever pin adapted to move along the rail as the blade trigger rotates from the rest position; and a drive arm coupled to the lever, where the drive arm includes a pin and a notch. The pin may be adapted to engage the guide and slide within the guide when the blade trigger rotates from the rest position. The notch may be adapted to engage the spring tongue when the blade trigger rotates from the rest position and convey the blade shuttle from the retracted position to the extended position when the blade trigger rotates from the rest position to the engaged position. The knife may further include a spring post integral to the housing, where the lever is coupled to the housing via the spring post. The knife may further include a lever spring coupled to the spring post and the lever, where the lever spring may be adapted to apply a torsional force to the lever and convey the blade trigger from the engaged position to the rest position via the transmission.

In some embodiments, the spring tongue may be adapted to bend while engaged with the notch when the blade shuttle moves from the retracted position to the extended position. The spring tongue may be adapted to disengage from the notch based on the blade receiving the force directed substantially perpendicular to the blade edge. Further, an angle between the drive arm and the lever may be between approximately 70 degrees and approximately 90 degrees. The knife may further include a trigger spring, where the trigger lock is in a locked position when the projection is in contact with the stop pin and the trigger lock is in an unlocked position when the projection is released from the stop pin. The trigger spring may urge the trigger lock from the unlocked position to the locked position.

In various embodiments, the trigger spring may be an integral spring extension of the trigger lock. Further, the trigger spring may be a compression spring coupled to one of the trigger lock and the blade trigger. The trigger lock may be adapted to receive a compressive force to convey the trigger lock from the locked position to the unlocked position. The blade trigger may be adapted to receive the compressive force to convey the blade trigger from the rest position to the engaged position. In some aspects, the knife may further include a clip coupled to the housing.

The knife housing may further include a blade aperture, a front housing edge at the blade aperture, and a front contour. The blade may extend through the blade aperture when the blade shuttle moves to the extended position. A plane tangential to the front housing edge and a plane tangential to the blade edge may define a first obtuse angle. A plane tangential to the front contour and a plane tangential to the blade may define a second obtuse angle. The first obtuse angle and the second obtuse angle may define a compound angle of cut.

The blade trigger may include a front portion and a back portion, where the front portion is nearest the blade aperture. The front and back portions may each define approximately one-half a length of the blade trigger. The trigger lock may be accessible at the exterior of the housing through the back portion of the blade trigger.

In some embodiments, the blade may include a mount hole and the blade shuttle may include an integral detent formed in a blade slot. The blade may be adapted to slide into the blade slot and engage the integral detent with the mount hole. The integral detent may include a leading edge and a back edge, where the leading edge is tapered from a base of the detent to a top of the detent. The back edge may be substantially perpendicular to the blade shuttle, and the blade may be adapted to engage the integral detent with the mount hole over the leading edge. The back edge may be adapted to substantially prevent decoupling of the blade from the blade shuttle.

Various implementations of a utility cutter according to the present disclosure may include one or more of the following features. The utility cutter may allow for safer cutting of near frictionless or low friction material, such as, for example, adhesive tape, polyfilm (or other polyurethane film), plastic bags, or other similar materials, such as high-density polyethylene (HDPE), low-density polyethylene (LDPE), or linear low-density polyethylene (LLDPE). The utility cutter may provide for safer cutting or slicing of such materials through an autoretracting cutting blade that returns within a protective handle based or an upward pressure against the blade. The autoretracting cutting blade may return within the protective handle without a frictional force exerted on the blade by a material or workpiece. But the autoretracting cutting blade may return within the protective handle based on a frictional force exerted on the blade by a material or workpiece as well. Thus, the utility cutter may provide for automatic blade return within the protective housing based on either a substantially perpendicular force exerted against the blade or based on a frictional force exerted on the blade substantially in parallel to the blade. The utility cutter may also provide a more ergonomic and comfortable fit for a user of the cutter. The utility cutter may include a locking mechanism that substantially prevents a blade from accidentally being extended from the cutter. The utility cutter may thus provide a safer cutting mechanism by substantially preventing accidental blade extensions. Also, the locking mechanism of the utility cutter may allow for blade extension substantially simultaneous with unlocking. The utility cutter may automatically retract a blade used for cutting or slicing a workpiece into a protective handle when the blade becomes disengaged from the workpiece regardless of whether the cutter is actuated or unactuated by the user. Furthermore, the utility cutter may allow for a substantially constant force to extend a blade from a fully retracted position to a fully extended position. Additionally, the utility cutter may provide for a lightweight and disposable mechanism for cutting or slicing rigid, semi-rigid, or flexible materials.

Various implementations of a utility cutter according to the present disclosure may also include one or more of the following features. The utility cutter may allow for less energy and effort to be utilized when slicing or cutting material through a compound angle of cut. The utility cutter may allow for reduced friction on a blade of the cutter thereby increasing the life of the blade and/or allowing for a cleaner cut of a workpiece. Additionally, the utility cutter may include a two-piece assembly housing that prevents user access to an interior of the assembly housing in order to avoid internal contamination. The utility cutter may include a two-piece assembly housing held together by security screws requiring specialized tooling to access the interior of the assembly housing, thereby preventing or minimizing internal contamination and malfunction. The utility cutter may allow a user to more comfortably cut a material without substantial injury. The utility cutter may be actuated with approximately 75% less force than typical utility cutters. The utility cutter may also substantially prevent injuries or workplace hazards due to loose cutting blades. The utility cutter may also more easily be carried or otherwise transported in a user's pocket or secured to an article of clothing.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

A utility cutter according to the present disclosure, generally, includes a protective handle or housing operable to enclose a blade shuttle and a blade coupled to the blade shuttle. Upon actuation of the utility cutter by a user by, for example, rotating a blade trigger, the blade shuttle and blade may be extended. At least a portion of the blade is exposed from the housing once the blade shuttle is extended. The user may cut or slice a variety of materials, such as polyfilm, corrugated board, adhesive tape, plastic bags or wrap, or cardboard, with the exposed blade. To ensure or increase the safety of the user, other persons, or valuable property, the exposed blade may automatically retract within the housing when the blade becomes disengaged from the material. For instance, a force directed substantially perpendicular to a cutting edge of the blade may disengage the blade shuttle (or a component attached thereto, such as a leaf spring) from one or more components of a blade transmission used to urge the blade shuttle into the extended position. Upon disengagement of, for instance, the blade shuttle from the blade transmission, the blade shuttle may be free to retract to an unactuated position, thereby automatically retracting the blade within the housing. In some embodiments, the blade shuttle may be free to retract to the unactuated, or back, position even if the blade trigger is actuated.

Figure 1:
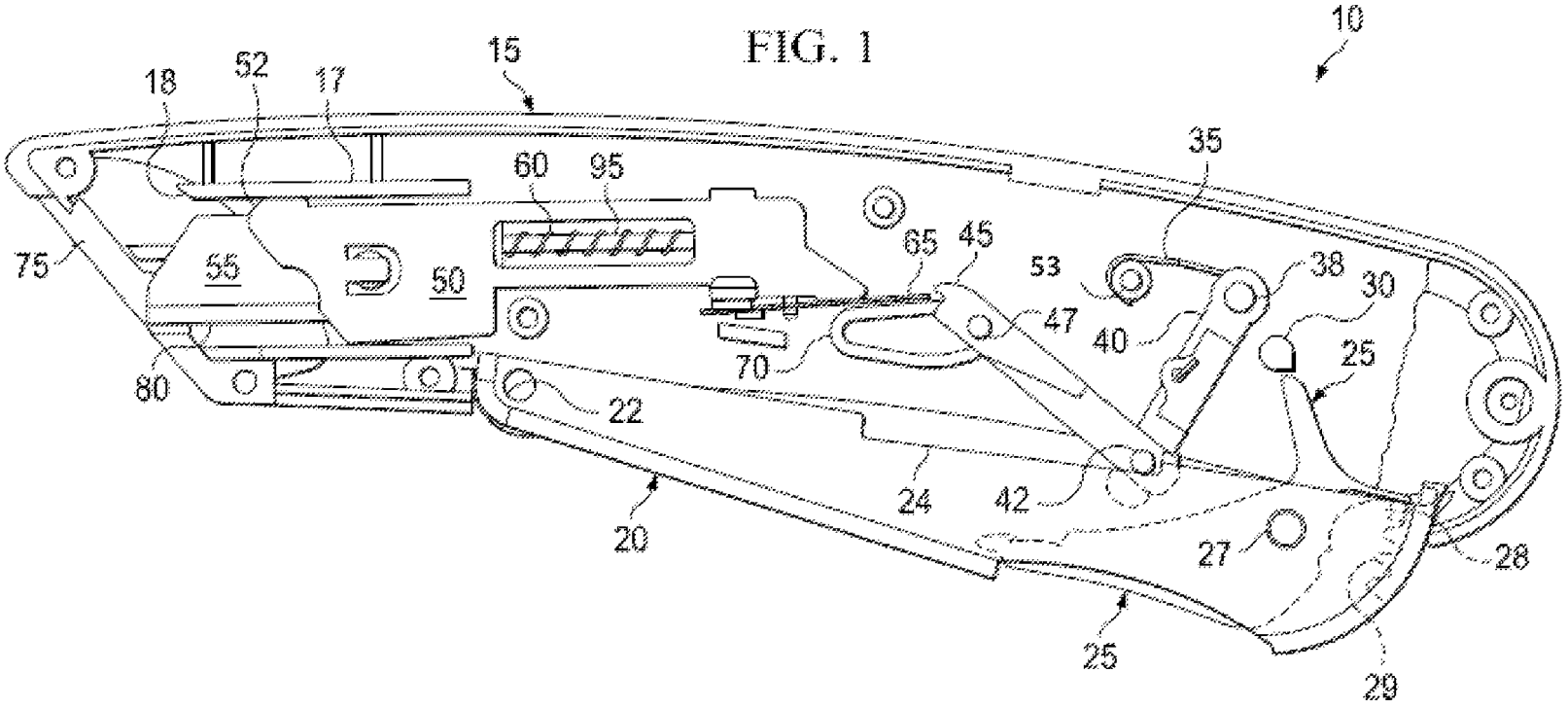
FIG. 1 illustrates one implementation of a utility cutter according to the present disclosure in a back position.

FIG. 1 illustrates one implementation of the utility cutter 10 in a back position according to the present disclosure. Utility cutter 10 includes, among other components, a housing 15 including a body rib 17, a blade trigger 20, a lever 40, a drive arm 45, a blade shuttle 50 including a tang 52 (e.g., a protrusion), and a blade 55. Generally, the utility cutter 10 provides a utility knife with an automatically retracting blade 55 when the blade 55 becomes disengaged from a material or workpiece, such that the blade shuttle 50 is decoupled from a blade extension system of the cutter 10 when the blade 55 receive a force perpendicular or substantially perpendicular to a blade edge 80 of the blade 55. In some implementations, the utility cutter 10 may also provide an integral trigger lock 25 within the blade trigger 20, which prevents the blade 55 from extending from the housing 15 while the cutter 10 is in a back position prior to activation (e.g., rotation) of the trigger lock 25. In some implementations, the trigger lock 25 may prevent accidental extension of the blade 55, thereby preventing a safety hazard for a user of the cutter 10 or others.

The housing, or handle, 15, of the utility cutter 10 encloses at least a portion of the components of the cutter 10 within a protective enclosure. Typically, the housing 15 may be manufactured as a stamped and extruded molded case (e.g., GF nylon), but alternatively, may be made of any appropriate rigid or semi-rigid material. For example, the housing 15 may be made from aluminum or steel, such as stainless steel, in certain implementations. The housing 15, however, may be made of a lightweight and cost efficient material such that the utility cutter 10 may be disposed of upon its end of life without significant economic loss.

Further, the housing 15, generally, may be a two-piece housing such that identical or substantially identical halves of the housing may be coupled together to enclose the components of the utility cutter 10. As a two-piece configuration, the housing 15 may be coupled together through mechanical means, such as screws, rivets, or a snap fit, or through adhesive material. In some aspects, the two halves of the housing 15 may be coupled together using specialty screws, such that a user of the utility cutter 10 may require a special tool to decouple the halves of the housing 15.

The housing 15 includes a blade aperture 75, which allows the blade 55 to extend from the housing 15 when the cutter 10 is actuated. In certain implementations, such as when the housing 15 includes a two-piece design, the blade aperture 75 may be formed at a distal end of the cutter 10 when the two halves of the housing 15 are coupled together. Further, the housing 15 includes an aperture along a bottom side of the housing 15 through which the blade trigger 20 may extend. Additionally, in some aspects, the housing 15 may include one or more integral protrusions extending from an interior wall of the housing 15 into the cavity formed by the two-piece enclosed housing 15. For example, in some aspects, the housing 15 may include a stop pin 30, a spring post 38, a body pin 53, and a slot 70. In some implementations of the housing 15, each half of the housing 15 may include a stop pin 30, a spring post 38, a body pin 53, and a slot 70. In such implementations, for example, the two stop pins 30, the two spring posts 38, and the two body pins 53 may meet in approximately the middle of the cavity formed in the housing 15. Alternatively, two stop pins 30 and two body pins 53 may be included that meet in approximately the middle of the cavity formed in the housing 15, while a single spring post 38 and a single slot 70 are included. In some implementations of the utility cutter 10, the stop pin 30 and the spring post 38 may be combined into one protrusion extending into the cavity and incorporating the functions described herein for these components.

As illustrated, the body rib 17 is integrally formed with the housing 10 and is disposed longitudinally on at least a portion of an interior surface of the housing 10. In some implementations, such as when the housing 10 is a two-piece (e.g., clamshell) housing, one or both sections of the housing may include a body rib 17. For instance, the body rib 17 may also be a two-piece component such that the two pieces meet or are adjacent at or near a longitudinal centerline of the housing 10.

In various embodiments, the body rib 17 may be detachably coupled to the housing 10 rather than integrally formed therewith.

Figure 2:
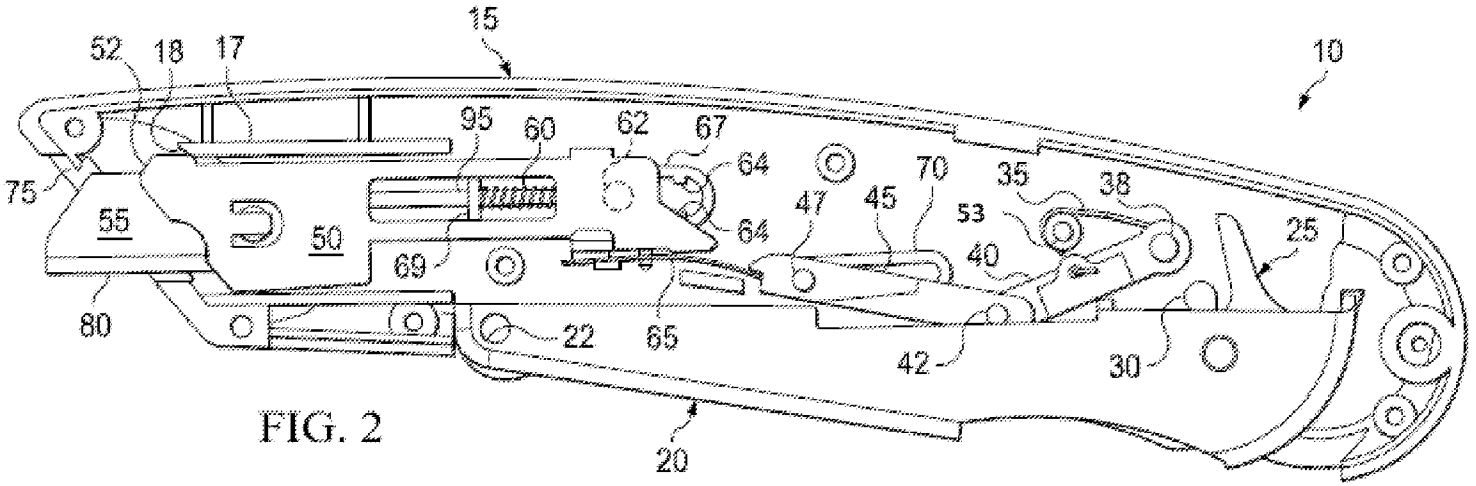
FIG. 2 illustrates one implementation of a utility cutter according to the present disclosure in an actuated position.

Generally, the body rib 17 may provide an upper limit or rail preventing the blade shuttle 50 from moving in an upward vertical direction while at rest or while moving longitudinally through the interior of the housing 10, such as, for example, when the blade shuttle 50 is urged from a back position to an extended position (shown in FIG. 2). A lower rail, as illustrated in FIG. 1, may, in some embodiments, be integrally formed with the interior surface of the housing 10 and may provide a lower limit preventing the blade shuttle 40 from moving in a downward vertical direction. The body rib 17 and lower rail may thus provide a channel disposed substantially longitudinal through at least a portion of the housing 10 for the blade shuttle 50 to move laterally therethrough.

In some implementations, the body rib 17 may include a tapered end 18 adjacent or near the blade aperture 75. The tapered end 18 may, in some aspects, assist the blade shuttle 50 as it moves upward from the actuated position to a cutting position (described further with reference to FIG. 3). In some embodiments of the utility cutter 10, the body rib 17 may include more than one tapered end therethrough. Such embodiments may be included, for example, on a utility cutter with multiple blade extension lengths. More specifically, a utility cutter may include a blade position selector coupled to, for example, the blade trigger 20. A position selector, generally, may allow a user of the utility cutter 10 to select one or more extended positions of the blade 55 when the blade trigger 20 is actuated. For example, a particular position that the user may select may provide for the blade 55 to extend from the blade aperture 75 an appropriate length to cut single wall corrugated board. Further, a second position may provide for the blade 55 to extend from the blade aperture 75 an appropriate length to cut twin wall corrugated board. Even further, a third position may provide for the blade 55 to extend from the blade aperture 75 an appropriate length to cut thicker or thinner material compared to the above-referenced examples. Of course, more selectable positions may be utilized as appropriate. In such embodiments of the utility cutter 10 including a position selector, the body rib 17 may include multiple apertures or slots therethrough, with the body rib 17 including a tapered end 18 leading to each slot or aperture. In some embodiments, the number of selectable blade extension positions may be equal to the number of slots or apertures through the body rib 17. Thus, regardless of the blade extension selected by the user, the blade shuttle 50 may operate as described below with reference to FIG. 3 for each selected blade extension position.

Continuing with FIG. 1, the blade trigger 20 is pivotally coupled to the housing 15 at a trigger pivot 22, thereby allowing the blade trigger 20 to rotate about the pivot 22 upon a compressive force being applied to the blade trigger 20 by the user of the utility cutter 10. Typically, the blade trigger 20 is ergonomically shaped to allow for a comfortable grip by the user of the cutter 10. In the back position, as shown in FIG. 1, the blade trigger 20 may extend further from the housing 15 than when the cutter 10 is in an actuated position (e.g., as shown in FIG. 2). In some implementations, the blade trigger 20 includes an internal cavity, which is hollow to allow the trigger lock 25 to be seated within the blade trigger 20. Further, the blade trigger 20 may also include one or more rails 24 that form a recessed portion along a top edge of the blade trigger 20. The rails 24 may be formed in a specified portion of the blade trigger 20, and typically, are formed in a middle third along the length of the top edge of the blade trigger 20. In some implementations, the length of the rails 24 may restrict a distance in which the blade 55 may extend from the housing 15 of the utility cutter 10 (i.e., the "throw" of the blade 55).

The trigger lock 25 is pivotally coupled to the blade trigger 20 at one or more lock pivots 27, and is substantially seated within the blade trigger 20. Generally, a portion of the trigger lock 25 extends through an aperture formed in the blade trigger 20 and to the exterior of the housing 15, thereby allowing access to the trigger lock 25 by the user of the utility cutter 10. In the back position, at least a portion of the trigger lock 25 is in contact with the stop pin 30. For example, as illustrated in FIG. 1, the trigger lock 25 includes an extended projection with a pointed end such that the projection overlaps and is in contact with the stop pin 30. Additionally, the trigger lock 25 may further include a cylinder 28. The utility cutter 10 may further include a spring 29. Generally, the cylinder 28 and the spring 29 may function in concert to return the trigger lock 25 from an unlocked position to a back position when the blade trigger 20 is released from an actuated position. For example, in the unlocked position, the trigger lock 25 may be rotated such that the cylinder 28 compresses the spring 29. In a compressive state, the spring 29 may apply a force to the trigger lock 25 thereby urging the lock 25 into the back (and locked) position. Alternatively, the trigger lock 25 may include an integral spring extension curved to fit within and apply a spring-like force against the blade trigger 20. Such an integral spring extension may extend from the trigger lock 25 and, in some aspects, may help ensure that the trigger lock 25 returns to the back position when the blade trigger 20 is released.

In some implementations of the utility cutter 10, the trigger lock 25 is positioned such that the lock 25 extends through an aperture formed in a back half of the blade trigger 20 furthest from the blade aperture 75 to the exterior of the housing 15. In such implementations, the user of the utility cutter 10 may grip the blade trigger 20 and the trigger lock 25 simultaneously, with one or more fingers positioned on the trigger lock 25. For example, the user may naturally and ergonomically grip the utility cutter 10 such that the user's third and/or fourth fingers may be positioned on the trigger lock 25 while the user's first and second fingers are positioned on the front half of the blade trigger 20. The user's thumb is typically placed around a top edge of the housing 15 during operation and handling of the utility cutter 10. Thus, upon a natural gripping movement by the user, the utility cutter 10 may be unlocked and actuated, thereby extending the blade 55 from the housing 15.

Lever 40 is an elongated member that is coupled at one end to the housing 15 via the spring post 38. An opposite end of the lever 40 includes one or more lever pins 42 protruding from the lever 40. In some implementations, the lever 40 extends into the cavity of the blade trigger 20 while lever pins 42, extending from either side of the lever 40, are seated upon the rails 24 of the blade trigger 20. In the back position, in the implementation illustrated in FIG. 1, the lever pins 42 are seated on the rails 24 at a position furthest from the blade aperture 75.

A lever spring 35 is coupled to the lever 40 at one end through a small aperture in the body of the lever 40 and may be wound around or coupled to the spring post 38, thereby providing a spring force against the lever 40. The lever spring 35, therefore, acts to force the lever 40 into the back position shown in FIG. 1, such that the lever pins 42 are seated against a back end of the rails 24 furthest from the blade aperture 75. Lever spring 35, in some implementations, is a wire spring made of spring steel.

As illustrated in FIG. 1, the drive arm 45 may include a slotted end coupled to the lever 40 via the lever pins 42 and a notched end opposite the slotted end that, when the utility cutter 10 is in the back position, receives a spring tongue 65 coupled to the blade shuttle 50. The drive arm 45, in some aspects, includes two substantially circular apertures, which fit over the lever pins 42 on either side of the lever 40. Like the lever 40, the end of the drive arm 45 that is coupled to the lever 40 may extend into the cavity of the blade trigger 20. The drive arm 45 may also include one or more guide pins 47 extending from the sides of the drive arm 45. The guide pins 47 may, for example, be insertable into corresponding slots 70 formed in the interior walls of the two-piece housing 15. In some implementations, the slots 70 may be designed with a specific length to control the "throw" of the blade by restricting the longitudinal movement of the guide pins 47 in the slots 70. In the back position shown in FIG. 1, the guide pins 47 are positioned at a back end of the slots 70 furthest from the blade aperture 75.

With regards to the drive arm 45, in some implementations of the utility cutter 10, this component may be set between approximately 70 and 90 degrees (e.g., 82 degrees) from the lever 40 when the utility cutter 10 is in the back position shown in FIG. 1. If the angle between the drive arm 45 and the blade trigger 20 is, for example, less than approximately 70 degrees, the blade trigger 20 may become substantially perpendicular to the rails 24 of the blade trigger 20, thereby causing the drive components (e.g., the lever 40 and the drive arm 45) to lock and substantially prevent rotation by the blade trigger 20. In some aspects, therefore, extension of the blade shuttle 50 from its retracted position may be substantially prevented.

Figure 3:
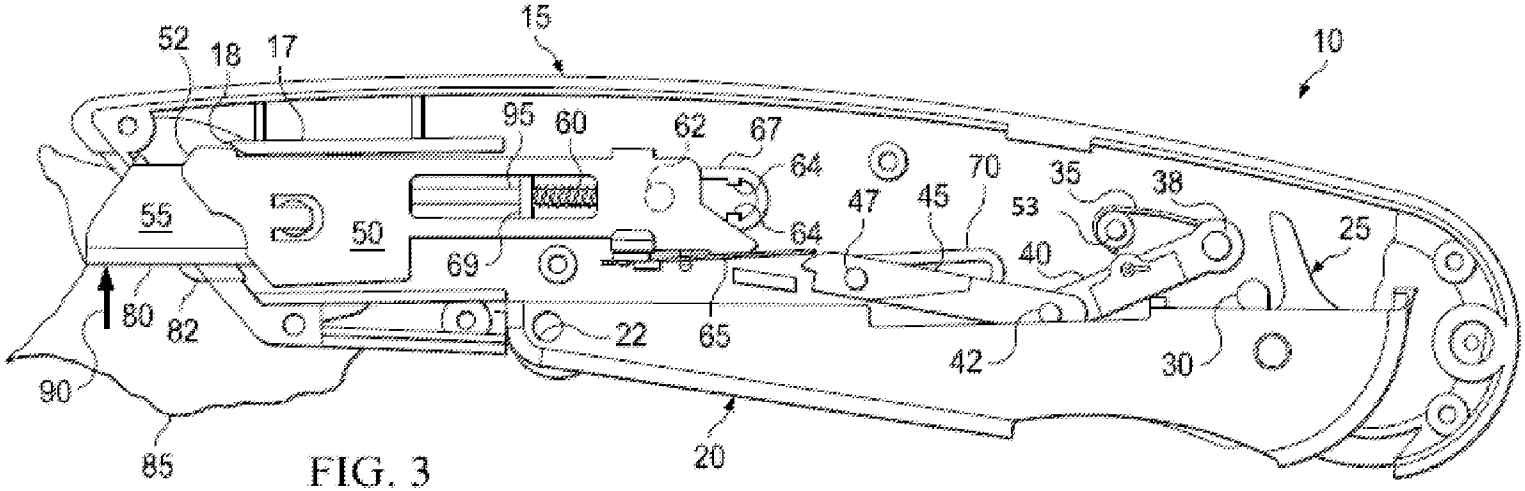
FIG. 3 illustrates one implementation of a utility cutter according to the present disclosure in a cutting position.

As illustrated in FIG. 1, the blade shuttle 50 is coupled to the blade 55 at one end of the shuttle 50 and the spring tongue 65 at the other end of the shuttle 50. The spring tongue 65 is, typically, substantially planar and rectangular in shape and made of a pliable material, thereby allowing the spring tongue 65 to bend during operation of the utility cutter 10. In some embodiments, the spring tongue 65 may be a leaf spring made of spring steel. The blade shuttle 50 may further include one or more integral shuttle pins 62 extending from either side of the shuttle 50. Turning briefly to FIG. 3, the shuttle pins 62 may be inserted into a shuttle guide 64 formed into the interior wall of the housing 10. The shuttle guide 64, typically, may be a channel-shaped extrusion with one or more ridges 67 formed transversely across the guide 64 at a rounded end. The guide 64 may also include a closed square end opposite the rounded end and closest to the blade aperture 75, including a small hole through which the spring rod 95 may be inserted. Thus, the spring rod 95 and shuttle spring 60 may be substantially enclosed within the shuttle guide 64 with the spring rod 95 protruding through the square closed end of the guide 64. The shuttle spring 60 may thus be constrained within the shuttle guide 64 between the ridges 67 and the square closed end. In some implementations, the shuttle pins 62 may have substantially no contact with the spring rod 95 and shuttle spring 60 when the utility cutter 10 is in the back position. Thus, the shuttle spring 60 may exert no force on the blade shuttle 50 when the utility cutter 10 is in the back position.

In some implementations, as illustrated, a shuttle pin 62 pushes the spring rod 95 forward toward the blade aperture 75 upon extension of the blade 55 from the housing 15, thereby placing the shuttle spring 60 into compression. In the back position shown in FIG. 1, however, the blade shuttle 50 is fully retracted into the housing 15 such that the blade 55 is also fully enclosed within the housing 15.

Figure 4A:
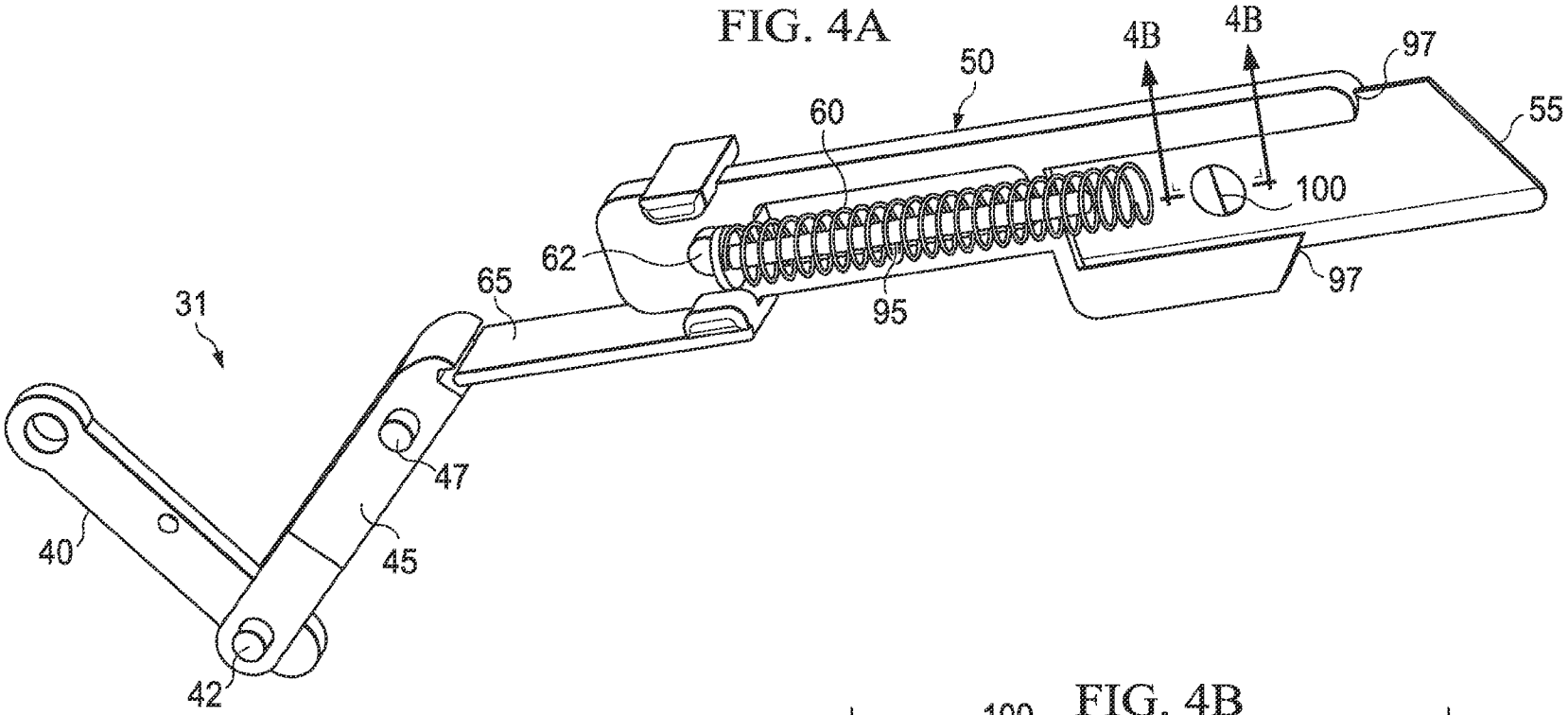
FIG. 4A illustrates one implementation of a transmission of a utility cutter according to the present disclosure.

Blade 55 is typically formed of steel with a sharpened cutting edge 80 and a rounded safety point at the leading end of the cutting edge 80. Further, the blade 55 typically includes a trapezoidal end and a substantially rectangular end, as shown in FIG. 4A. Alternatively, the blade 55 may be a trapezoidal-shaped blade. In some implementations, the blade 55 may be segmented such that portions of the blade 55 may be removed when no longer usable (e.g., dulled or broken by use). The blade 55, however, may be disposable such that upon the end of its useful life, a replacement blade may be inserted into the utility cutter 10, or a replacement utility cutter 10 may be used.

The blade 55 may be coupled to the blade shuttle 50 through mechanical means, such as a screw or rivet, or alternatively, may be attached to the blade shuttle 50 through adhesive means. In some implementations of the utility cutter 10, as more fully shown in FIG. 4A, the blade 55 may be detachably coupled to the blade shuttle 50 via a spring detent 100 integrally formed into the shuttle 50.

FIG. 2 illustrates the utility cutter 10, according to one implementation, in an actuated position. In some implementations, when the user of the utility cutter 10 determines that the blade 55 should be extended from the housing 15, the cutter 10 may first be unlocked. In order to place the cutter 10 into its unlocked position, the trigger lock 25 may be rotated relative to the blade trigger 20 such that the trigger lock 25 is no longer in contact with the stop pin 30. Alternatively, the utility cutter 10 may not include a trigger lock and the user may actuate the utility cutter (i.e., adjust the utility cutter 10 from the back position to the actuated position) with no need to first unlock the cutter 10.

As shown in the implementation of FIGS. 1-2 including the trigger lock 25, upon a compressive force being applied to the trigger lock 25 in the back position, the trigger lock 25 may be rotated clockwise about the lock pivot 27. Upon rotation, the projection of the trigger lock 25 slides past the stop pin 30 such that the trigger lock 25 is no longer in contact with the stop pin 30. The utility cutter 10 is thereby placed into the unlocked position. If the user, however, applies a compressive force only to the blade trigger 20 before the utility cutter 10 is unlocked, the utility cutter 10 will remain in the back position shown in FIG. 1. For example, if a compressive force is applied to the blade trigger 20 only, the blade trigger 20 will attempt to rotate counterclockwise about the trigger pivot 22. The trigger lock 25, however, remains in contact with the stop pin 30, thereby preventing the blade trigger 20 from substantially any rotation and preventing substantially any extension of the blade shuttle 50 and blade 55.

In some aspects, the stop pin 30 may be substantially teardrop in shape with a pointed end directed away from the blade aperture 75. In such implementations, the trigger lock 25 may more easily slide past the stop pin 30 upon the compressive force being applied to the trigger lock 25. The stop pin 30 and the trigger lock 25, however, may be any appropriate shapes that substantially prevent rotation of blade trigger 20 without a prior or substantially simultaneous rotation of the trigger lock 25. For example, the larger in circumference the stop pin 30, the greater the interference that may occur between it and the trigger lock 25. Thus, the size and shape of the stop pin 30 may correlate to the amount of force required to rotate the trigger lock 25 from the back position to the unlocked position.

Subsequent to the utility cutter 10 being placed in the unlocked position, the cutter 10 may be placed into the actuated position. In some implementations, the user may place the utility cutter 10 into the actuated position in multiple fashions. For example, after the compressive force rotates the trigger lock 25 such that the stop pin 30 no longer impedes the rotation of the blade trigger 20, additional compressive force on the trigger lock 25 may be transmitted to the blade trigger 20, thereby causing rotation of the blade trigger 20 about the trigger pivot 22. As another example, a compressive force applied to the blade trigger 20 subsequent to the utility cutter 10 being placed in the unlocked position (in place of or in addition to the additional compressive force being applied to the trigger lock 25) may cause rotation of the blade trigger 20 about the trigger pivot 22.

As illustrated in FIG. 2, rotation of the blade trigger 20 about the trigger pivot 22 moves the blade shuttle 50 from the refracted position to the extended position, thereby extending the blade 55 through the blade aperture 75. As the blade trigger 20 rotates, the lever pins 42 slide forward along the rails 24. The drive arm 45, coupled to the lever 40 at the lever pins 42, is thereby pushed forward toward the blade aperture 75. The guide pins 47 move forward within the slots 70, which may be, in some aspects, positioned such that movement of the guide pins 47 is substantially parallel to the movement of the blade shuttle 50 as it moves from the retracted position to the extended position.

The forward movement of the drive arm 45 may be transferred to the blade shuttle 50 through the spring tongue 65 engaged with the notch end of the drive arm 45. The spring tongue 65 may, in some aspects, bend downward as the drive arm 45 exerts a forward-directed force on the blade shuttle 50, but, typically, stays engaged with the drive arm 45 while the blade shuttle 50 moves from its retracted position to its extended position.

As the blade shuttle 50 is pushed from the retracted position to the extended position, the shuttle pin 62 slides within the shuttle guide 67, past the ridges 64, and engages the spring rod 95. In some implementations, as shown in FIG. 4A, the spring rod 95 includes a flattened end, which the shuttle pin 62 engages as it moves forward. As the spring rod 95 is pushed forward by the blade shuttle 50, the shuttle spring 60 becomes compressed, thereby exerting a force against the spring rod 95 urging the blade shuttle 50 into its retracted position. Continuing with FIG. 2, as the blade shuttle 50 moves from the retracted position to the extended position, the blade 55 extends from the housing 15 through the blade aperture 75 and may engage a workpiece 85 (e.g., polyfilm, cardboard, paper, corrugated board, plastic, rubber, adhesive tape).

As the blade shuttle 50 is pushed from its retracted to extended position, the tang 52 disposed on an upper edge of the shuttle 50 moves longitudinally toward the blade aperture 75 as well. The tang 52, in some embodiments, may be in contact with the body rib 17 as the blade shuttle 50 is moved to the extended position. Alternatively, the tang 52 may be adjacent to the body rib 17 as the blade shuttle 50 is extended without coming into contact with the rib 17. In the extended position, the tang 52 may be adjacent the tapered end 18 of the body rib 17, as illustrated in FIG. 2.

In some implementations of the utility cutter 10, an angle between the drive arm 45 and the lever 40 may be between approximately 70 degrees and approximately 90 degrees when in the retracted position. An initial force necessary to begin rotation of the blade trigger 20 and overcome the inertia of the components of the cutter 10 in the back position may therefore be substantially equal to a force required to extend the blade 55 from the housing 15 once the components of the cutter (e.g., blade trigger 20, lever 40, drive arm 45, and blade shuttle 50) are set in motion. For example, the initial force required to rotate the blade trigger 20 may be approximately 8 ounces while the force required to extend the blade 55 may be between approximately 7-8 ounces. In such fashion, the user of the utility cutter 10 may expend less energy in actuating the cutter 10, thereby allowing for more ease of use and less chance of injury from use of the cutter 10.

FIG. 3 illustrates the utility cutter 10 in a cutting position with the blade 55 engaged in the workpiece 85. In some implementations, the blade 55 may create an "anvil" or "guillotine"-type cut into the workpiece 85, such that a force 90 is directed perpendicular or substantially perpendicular to the blade 55 by the contact with the workpiece 85. As the force 90 is applied to the cutting edge 80 of the blade 55 and transferred to the blade shuttle 50, the tang 52 slides upward along the tapered end 18 of the body rib 17. For example, in some implementations, the blade shuttle 50 is adjusted approximately 0.040 inches upward. The blade shuttle 50, thus, is moved to the cutting position. In some embodiments, as the blade shuttle 50 is adjusted upward into the cutting position, the spring tongue 65 becomes disengaged from the drive arm 45 and returns to a straightened position. As the user cuts or slices the workpiece 85, tension between the workpiece 85 and the blade 55 may hold the blade 55 exposed from the handle 15.

In some implementations, the blade shuttle 50 may be adjusted from the extended position to the cutting position through alternate techniques. For example, once the blade 55 engages the workpiece 85, a frictional force directed substantially parallel to the blade edge 80 and away from the blade aperture 75 may be generated between the blade 55 by the workpiece 85. The blade 55 may thus be extended a short distance further from the blade aperture 75. For example, the blade 55 may be extended approximately one-sixteenth of an inch when engaged with the workpiece 85. The blade shuttle 50 (coupled to the blade 55) is thereby extended from the extended position to the cutting position by substantially the same distance. As the blade shuttle 50 is extended longitudinally due to the frictional force, the spring tongue 65 may be disengaged from the drive arm 45.

In some implementations, once the blade 55 become disengaged from the workpiece 85 and force (e.g., the force 90 and/or the frictional force) is no longer applied to the blade 55, the shuttle spring 60 uncoils to automatically retract the blade shuttle 50 from its cutting position to its retracted position. More specifically, the shuttle spring 60 is compressed as the blade shuttle 50 moves from the retracted position to the extended position. The spring force exerted on the shuttle pin 62 by the shuttle spring 60 may be transferred to the blade shuttle 50, thereby returning the blade shuttle 50 to its retracted position.

In some aspects of the utility cutter 10, the blade shuttle 50 may return to its retracted position when the blade trigger 20 is actuated. As illustrated in FIG. 3, when the spring tongue 65 becomes disengaged from the drive arm 45, the spring tongue 65 may return from a bent position to a substantially horizontal position. Thus, when the blade 55 becomes disengaged from the workpiece 85, the blade shuttle 50 may return to its retracted position with substantially no interference between the spring tongue 65 and the drive arm 45. Once the blade shuttle 50 is in the retracted position, if the blade trigger 20 is released by the user, thereby moving the trigger 20 from the actuated position to an unactuated position, the drive arm 45 may return and reengage the spring tongue 65. More specifically, upon release of the blade trigger 20 by the user, the lever spring 35 acts to return the lever 40 and the drive arm 45 to their respective positions shown in FIG. 1. For example, the lever 40 rotates counterclockwise about the spring post 38, thereby sliding the lever pins 42 backwards along the rails 24. As the lever pins 42 slide backward, the drive arm 45 may be pulled backward while the guide pins 47 remain in the slots 70. Further, as the blade trigger 20 rotates clockwise into its unactuated position, the trigger lock 25 may reengage the stop pin 30, thereby placing the utility cutter 10 into the back position (shown in FIG. 1).

Alternatively, if the blade trigger 20 is in the unactuated position (as shown in FIG. 1) when the blade 55 becomes disengaged from the workpiece 85, the spring tongue 65 may move freely back upon retraction of the blade shuttle 50 until the tongue 65 reengages the drive arm 45. Thus, the blade shuttle 50 may be automatically retracted from the cutting position regardless of whether the blade trigger 20 is in the actuated position or the unactuated position.

Figure 5:
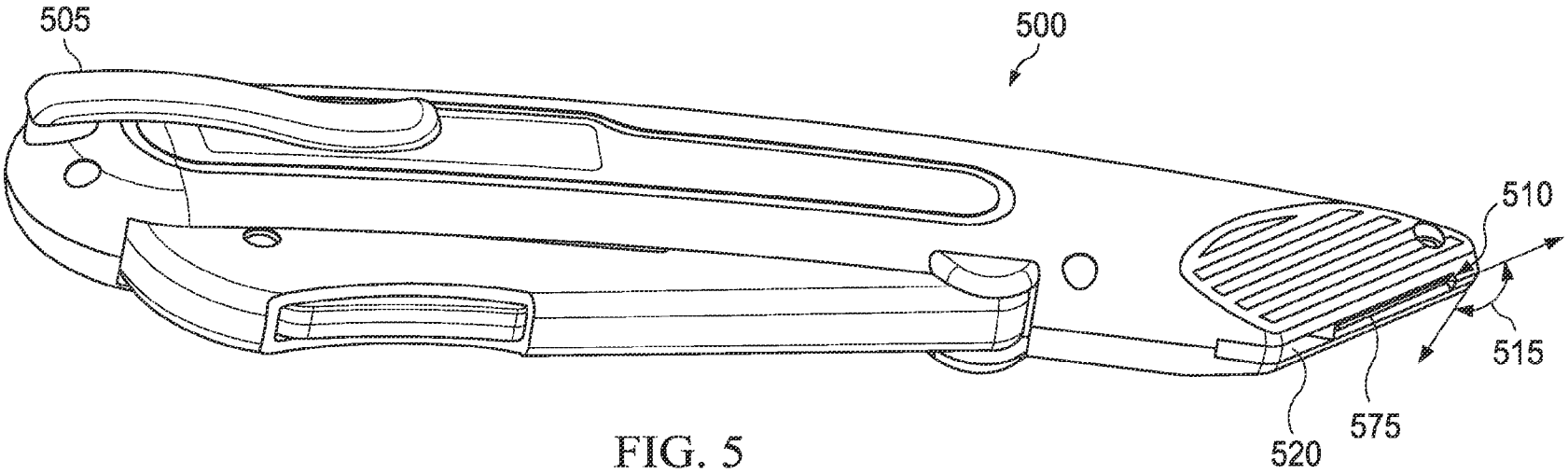
FIG. 5 illustrates another implementation of a utility cutter according to the present disclosure.

As illustrated in FIG. 3, a first cutting angle 82 is illustrated between the cutting edge 80 of the blade 55 and the blade aperture 75 of the housing 15. The first cutting angle 82 may be an obtuse angle (e.g., greater than 90 degrees). Turning briefly to FIG. 5, the utility cutter 10 may also include a housing contour 510, which creates a second cutting angle 515 between an extension plane of the blade 55 and the housing contour 510. The second cutting angle 515, as shown in FIG. 5, may also be an obtuse angle (e.g., greater than 90 degrees). Taken together, the first cutting angle 82 and the second cutting angle 515 may create a compound angle of cut of the blade 55, thus allowing the blade 55 to more easily slice a material, such as the workpiece 85. In some aspects, the compound angle of cut may reduce the energy and labor required to make a cut with the utility cutter 10 by, for example, providing a falling edge such that cut material may more easily be removed and fall off the edge.

FIG. 4A illustrates one implementation of a transmission 31 of the utility cutter 10 according to the present disclosure. The transmission 31 includes, for example, the lever 40, including the lever pins 42, and the drive arm 45. Generally, the transmission 31 converts rotational movement of the blade trigger 20 into lateral movement of the blade shuttle 50. FIG. 4A further illustrates another view of the blade shuttle 50, the blade 55, the shuttle spring 60, and the spring rod 95. As illustrated in FIG. 4A, the spring rod 95 may be inserted through the shuttle spring 60. The spring rod 95 may protrude through a hole in wall 69 of the shuttle guide 67 while the shuttle spring 60 is enclosed within the guide 67 (as shown in more detail in FIGS. 2 and 3).

Figure 4B:
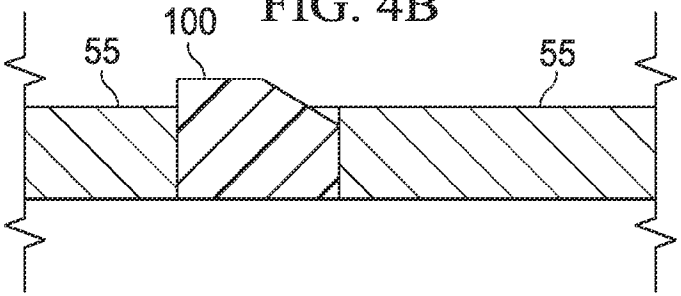
FIG. 4B illustrates one implementation of a blade shuttle and blade of a utility cutter according to the present disclosure.

FIG. 4B further illustrates a spring detent 100 that may be integrally formed in the blade shuttle 50. Generally, the spring detent 100 provides a coupling means by which the blade 55 may be detachably coupled to the blade shuttle 50, allowing the blade 55 to be removed when necessary while securing the blade 55 to the blade shuttle 50 during use of the utility cutter 10. In some implementations, the spring detent 100 may include a tapered front profile, as shown in the sectional view "A-A" of FIG. 4A. In such implementations, the blade 55 may be coupled to the blade shuttle 50 by ramping the blade 55 up the tapered front profile until an aperture in the blade 55 fits over the spring detent 100. The spring detent 100 also may include a square back profile that allows the blade 55 to secure to the blade shuttle 50 even under a tensile force applied by, for example, use of the blade 55 in cutting a workpiece 85. Additionally, as shown in FIG. 4A, the blade shuttle 50 may include one or more blade slots 97 in which the blade 55 may be inserted upon coupling with the shuttle 50. In some aspects, the blade slots 97 may apply a frictional force against the blade 55, thereby helping prevent, in part, unwanted removal of the blade 55 from the blade shuttle 50.

FIG. 5 illustrates one implementation of a trigger lock and blade trigger of a utility cutter 500 according to the present disclosure. In some aspects, the utility cutter 500 may be substantially similar to the utility cutter 10 as described with reference to FIGS. 1 through 3 above and include a clip 505. Clip 505, generally, may provide a user of the cutter 500 a mechanism to attach the cutter 500 to a belt, tool belt, clothing portions, toolbox, or other locations as appropriate during periods of non-use of the cutter 500 and may be coupled to the cutter 500 on either side. The clip 505 may, in some implementations, rotate about an axis perpendicular to the longitudinal dimension of the utility cutter 500 to allow for easier fastening to, for example, the user's belt or clothing. Further, the clip 505 may be detachable from and re-attachable to the cutter 500 as needed.

Utility cutter 500 may also include a blade aperture 575 sized appropriately for allowing previously cut particles of a material or workpiece to enter the housing of the cutter 500 through the aperture 575. For example, while cutting certain material (e.g., corrugated board), particles of the material may contain an adhesive or resin (or similar substance) that may build up on or within the blade aperture 575. Thus, sufficient clearance between the housing and the blade through the blade aperture 575 may become unavailable. As this resin builds up on or within the blade aperture 575, the blade may be prevented or substantially prevented from extending from the housing, thereby preventing use of the utility cutter 500. In some embodiments, the blade aperture 575 may be approximately 0.035 inches in order to allow such particles to enter the housing rather than become entrained at or within the blade aperture 575. In some embodiments, this may allow for decreased resin or adhesive buildup, which may allow for decreased problems with blade extension.

The utility cutter 500 may also include a wear piece 520 disposed adjacent and below the blade aperture 575. Typically, the wear piece 520 may prevent deformation or failure of the portion of the housing below the blade aperture 575 caused by, for example, heat generated by cutting friction as the utility cutter 500 is used to cut or slice a material or workpiece. In some embodiments, for example, the wear piece 520 may be a material distinct from the housing material and able to withstand greater heat and/or friction without deformation as compared to the housing material. For instance, the wear piece 520 may be made from metal (e.g., aluminum, stainless steel) while the housing material may be plastic or other suitable synthetic or semisynthetic solid material. The work piece 520 may thus allow for an extended life and use of the utility cutter 500 by preventing such deformation or failure of the housing material at or near the blade aperture 575.

A number of implementations have been described. Nevertheless, it will be understood that various modifications may be made. Accordingly, other implementations are within the scope of the following claims.

What is claimed is:

1. A knife comprising:

a housing;

a blade comprising a cutting edge adapted to engage a material, the blade coupled to a blade shuttle, the blade and blade shuttle substantially enclosed within the housing when the blade shuttle is in a retracted position, the blade extended from the housing when the blade shuttle is in an extended position, the blade shuttle adapted to be conveyed to the retracted position upon decoupling of the blade shuttle from a blade trigger through a blade transmission based on the blade receiving a force on, and directed substantially perpendicular to, the cutting edge from the material, and based on a frictional force between the blade and the material that is less than a spring force exerted on the blade shuttle from a shuttle spring;

the blade trigger pivotally coupled to the housing, the blade shuttle conveyed from the retracted position to the extended position when the blade trigger pivots from a rest position to an engaged position where the blade trigger is at least partially enclosed within the housing; and a trigger lock that comprises a trigger spring positioned between a trigger lock and the blade trigger to urge the trigger lock from an unlocked position to a locked position, wherein the shuttle spring is coupled to the blade shuttle and adapted to convey the blade shuttle to the refracted position, the shuttle spring adapted to automatically convey the blade shuttle to the retracted position upon disengagement of the blade from the material when the blade trigger is in the engaged position.

2. The knife of claim 1, wherein the shuttle spring exerts no force on the blade shuttle when the blade shuttle is in the retracted position.

3. The knife of claim 1, further comprising a transmission adapted to transfer a rotational movement of the blade trigger as the blade trigger rotates from the rest position to the engaged position to a lateral movement directed to convey the blade shuttle from the retracted position to the extended position.

4. The knife of claim 1, the blade shuttle further comprising a tang, the knife further comprising a rib coupled to an inner surface of the housing, wherein the tang is adjacent the rib as the blade shuttle is conveyed from the retracted position to the extended position.

5. The knife of claim 4, wherein the rib further comprises at least one notch therethrough, the tang adapted to protrude into the notch when the blade receives the force.

6. The knife of claim 4, wherein the rib is tapered adjacent the notch, the tapered portion of the rib angled away from the blade edge.

7. The knife of claim 1, the blade trigger further comprising a cavity, and the trigger lock comprising a projection, wherein the trigger lock substantially enclosed within the cavity and accessible at an exterior of the housing through the blade trigger, the trigger lock pivotally coupled to the blade trigger, the projection in contact with a stop pin coupled to the housing when the blade shuttle is in the retracted position, the blade trigger substantially prevented from pivoting from the rest position to the engaged position when the projection is in contact with the stop pin, the projection released from the stop pin upon rotation of the trigger lock, the blade trigger pivotable from the rest position to the engaged position when the projection is released from the stop pin.

8. The knife of claim 3, wherein the blade shuttle comprises a spring tongue and the blade trigger further comprises a rail, the transmission comprising:

at least one guide integrally formed in an interior surface of the housing;

a lever coupled to the housing, the lever comprising at least one lever pin adapted to move along the rail as the blade trigger rotates from the rest position; and a drive arm coupled to the lever, the drive arm comprising a pin and a notch, the pin adapted to engage the guide and slide within the guide when the blade trigger rotates from the rest position, the notch adapted to engage the spring tongue when the blade trigger rotates from the rest position, the notch adapted to convey the blade shuttle from the retracted position to the extended position when the blade trigger rotates from the rest position to the engaged position.

9. The knife of claim 8, further comprising:

a spring post integral to the housing, the lever coupled to the housing via the spring post; and a lever spring coupled to the spring post and the lever, the lever spring adapted to apply a torsional force to the lever and convey the blade trigger from the engaged position to the rest position via the transmission.

10. The knife of claim 8, the spring tongue adapted to bend while engaged with the notch when the blade shuttle moves from the retracted position to the extended position, the spring tongue adapted to disengage from the notch based on the blade receiving the force directed substantially perpendicular against the blade edge.

11. The knife of claim 8, wherein an angle between the drive arm and the lever is between approximately 70 degrees and approximately 90 degrees.

12. The knife of claim 7, wherein the trigger lock in a locked position when the projection is in contact with the stop pin, the trigger lock in an unlocked position when the projection is released from the stop pin, the trigger spring urging the trigger lock from the unlocked position to the locked position.

13. The knife of claim 12, wherein the trigger spring is an integral spring extension of the trigger lock.

14. The knife of claim 12, wherein the trigger spring comprises a compression spring coupled to one of the trigger lock and the blade trigger.

15. The knife of claim 12, wherein the trigger lock is adapted to receive a compressive force to convey the trigger lock from the locked position to the unlocked position, the blade trigger adapted to receive the compressive force to convey the blade trigger from the rest position to the engaged position.

16. The knife of claim 1, wherein the housing further comprises:

a blade aperture, the blade extended through the blade aperture when the blade shuttle moves to the extended position;

a front housing edge at the blade aperture, a plane tangential to the front housing edge and a plane tangential to the blade edge defining a first obtuse angle; and a front contour, a plane tangential to the front contour and a plane tangential to the blade defining a second obtuse angle, the first obtuse angle and the second obtuse angle defining a compound angle of cut.

17. The knife of claim 1, wherein the blade comprises a mount hole and the blade shuttle comprises an integral detent formed in a blade slot, the blade adapted to slide into the blade slot and engage the integral detent with the mount hole.

18. The knife of claim 17, wherein the integral detent comprises a leading edge and a back edge, the leading edge tapered from a base of the detent to a top of the detent, the back edge substantially perpendicular to the blade shuttle, the blade adapted to engage the integral detent with the mount hole over the leading edge, the back edge adapted to substantially prevent decoupling of the blade from the blade shuttle.

19. A knife comprising:

a housing;

a blade comprising a blade edge adapted to engage a material, the blade coupled to a blade shuttle, the blade and blade shuttle substantially enclosed within the housing when the blade shuttle is in a retracted position, the blade extended from the housing when the blade shuttle is in an extended position, the blade shuttle adapted to be conveyed to the retracted position based on the blade receiving a force directed substantially perpendicular to the blade edge;

a blade trigger pivotally coupled to the housing, the blade shuttle conveyed from the retracted position to the extended position when the blade trigger pivots from a rest position to an engaged position, wherein the blade trigger comprises a cavity, the knife further comprising a trigger lock comprising a projection, the trigger lock substantially enclosed within the cavity and accessible at an exterior of the housing through the blade trigger, the trigger lock pivotally coupled to the blade trigger, the projection in contact with a stop pin coupled to the housing when the blade shuttle is in the retracted position, the blade trigger substantially prevented from pivoting from the rest position to the engaged position when the projection is in contact with the stop pin, the projection released from the stop pin upon rotation of the trigger lock, the blade trigger pivotable from the rest position to the engaged position when the projection is released from the stop pin;

a shuttle spring coupled to the blade shuttle and adapted to convey the blade shuttle to the retracted position; and a trigger spring, the trigger lock in a locked position when the projection is in contact with the stop pin, the trigger lock in an unlocked position when the projection is released from the stop pin, the trigger spring urging the trigger lock from the unlocked position to the locked position, wherein the trigger spring comprises a compression spring coupled to one of the trigger lock and the blade trigger.

20. A knife comprising:

a housing;

a blade comprising a blade edge adapted to engage a material, the blade coupled to a blade shuttle, the blade and blade shuttle substantially enclosed within the housing when the blade shuttle is in a retracted position, the blade extended from the housing when the blade shuttle is in an extended position, the blade shuttle adapted to be conveyed to the retracted position based on the blade receiving a force directed substantially perpendicular to the blade edge;

a blade trigger pivotally coupled to the housing and comprising a cavity, the blade shuttle conveyed from the retracted position to the extended position when the blade trigger pivots from a rest position to an engaged position;

a trigger lock comprising a projection, the trigger lock substantially enclosed within the cavity and accessible at an exterior of the housing through the blade trigger, the trigger lock pivotally coupled to the blade trigger, the projection in contact with a stop pin coupled to the housing when the blade shuttle is in the retracted position, the blade trigger substantially prevented from pivoting from the rest position to the engaged position when the projection is in contact with the stop pin, the projection released from the stop pin upon rotation of the trigger lock, the blade trigger pivotable from the rest position to the engaged position when the projection is released from the stop pin;

a trigger spring, maintaining the trigger lock in a locked position when the projection is in contact with the stop pin, and the trigger lock in an unlocked position when the projection is released from the stop pin, the trigger spring urging the trigger lock from the unlocked position to the locked position and is adapted to receive a compressive force to convey the trigger lock from the locked position to the unlocked position, the blade trigger adapted to receive the compressive force to convey the blade trigger from the rest position to the engaged position; and a shuttle spring coupled to the blade shuttle and adapted to convey the blade shuttle to the retracted position.

* * * * *

UNITED STATES PATENT AND TRADEMARK OFFICE

CERTIFICATE OF CORRECTION

PATENT NO. : 8,931,180 B2
APPLICATION NO. : 13/674567
DATED : January 13, 2015
INVENTOR(S) : Raymond E. Davis and Clifton Glenn Hampton It is certified that error appears in the above-identified patent and that said Letters Patent is hereby corrected as shown below:

IN THE SPECIFICATION:

Column 1, line 38, delete “knife” and insert -- knife. --, therefore.

Column 11, line 13, delete “refracted” and insert -- retracted --, therefore.

IN THE CLAIMS:

Column 15, line 11, delete “refracted” and insert -- retracted --, therefore.

Signed and Sealed this
Fifth Day of May, 2015

Michelle K. Lee

Michelle K. Lee
*Director of the United States Patent and Trademark Office*